US005860339A

United States Patent [19]

Mikic et al.

[11] Patent Number: 5,860,339

[45] Date of Patent: *Jan. 19, 1999

[54] DRIVE CONFIGURATION WITH DIFFERENTIAL DRIVING SURFACES

[75] Inventors: Frank Mikic, deceased, late of Lake Geneva; Mark Eberhage, Greenfield, legal representative; Jeffrey H. Hoff, Kenosha, all of Wis.

[73] Assignee: Snap-on Technologies, Inc., Lincolnshire, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 706,801

[22] Filed: Sep. 3, 1996

[51] Int. Cl.[6] ..... B25B 13/06; B25B 13/08

[52] U.S. Cl. ..... 81/186; 81/119; 81/121.1

[58] Field of Search ..... 81/186, 441, 436, 81/119, 121.1, 124.3, 124.2, 124.7

[56] References Cited

U.S. PATENT DOCUMENTS

| | | | |
|---|---|---|---|
| 347,262 | 8/1886 | Wood . | |
| 503,124 | 8/1893 | Conver | 81/186 X |
| 641,292 | 1/1900 | Hinton | 81/186 X |
| 1,321,776 | 11/1919 | Stepanian . | |
| 1,590,200 | 6/1926 | McGuckin . | |
| 1,875,815 | 9/1932 | Kneier | 81/125.1 |
| 2,700,315 | 1/1955 | Hermanson | 81/186 X |
| 2,813,450 | 11/1957 | Dzus . | |
| 3,757,614 | 9/1973 | Evans et al. . | |
| 3,785,226 | 1/1974 | Ward . | |
| 3,903,764 | 9/1975 | Andersen . | |
| 3,996,819 | 12/1976 | King . | |
| 4,126,063 | 11/1978 | Palmer . | |
| 4,947,712 | 8/1990 | Brosnan . | |
| 5,092,203 | 3/1992 | Mader et al. . | |
| 5,131,312 | 7/1992 | Macor . | |
| 5,148,726 | 9/1992 | Huebschen et al. . | |
| 5,284,073 | 2/1994 | Wright et al. . | |
| 5,361,657 | 11/1994 | Terry . | |
| 5,388,486 | 2/1995 | Ruzicka et al. . | |
| 5,406,868 | 4/1995 | Foster . | |
| 5,429,018 | 7/1995 | Miller . | |
| 5,449,260 | 9/1995 | Whittle . | |
| 5,450,776 | 9/1995 | Kozak . | |
| 5,476,024 | 12/1995 | Hsieh | 81/186 X |

*Primary Examiner*—D.S. Meislin
*Attorney, Agent, or Firm*—Emrich & Dithmar

[57] ABSTRACT

A wrenching member includes at least two spaced-apart and substantially oppositely facing drive surfaces, each of which has a roughened region and an unroughened region thereon, with the roughened region being disposed adjacent to one end of one of the drive surfaces and adjacent to the other end of the other drive surface so as to afford a differential driving arrangement which exerts a greater frictional wrenching force in one direction than in the opposite direction.

19 Claims, 1 Drawing Sheet

12
13
17
10
11
14
16

12
13
11
23
26
20
28
22
24
15
21
27
22
25
29
23
14

34
32
54
53
52
35
51
54
53
52
51
30
36
33
34

16
30B
11
30A
33
36
32
35
34
30C
34
30F
30D
30E 41
45A
42
46
45B
45D
46
45C 40
41
5
5
42

DRIVE CONFIGURATION WITH DIFFERENTIAL DRIVING SURFACES

BACKGROUND OF THE INVENTION

1. Field of the Invention

This invention relates generally to drive surface configurations of the type which are commonly used with driving elements, such as wrenching members.

2. Description of the Prior Art

There are many types of known drive elements for driving associated fasteners or other driven members. For example, one common type of drive element is a wrench, which may have a handle, with a wrenching head at either or both ends. Another common type of drive element is a socket tool for use with associated handle or lever members. Each such drive element typically has at least two drive surfaces which are dimensioned and arranged for engagement, respectively, with corresponding flat sides of an associated fastener or other driven member of appropriate size. The driving surfaces are commonly smooth planar surfaces.

A disadvantage of such a driving element is the inadequate gripping force between the driving surfaces and the associated driven member. As a result, the driving element may have a tendency to slip off the driven member when torque is applied thereto. Also, it increases stress in the associated driven member and can tend to deform the corners thereof. This tendency to round off the corners of a fastener or other driven member is particularly likely to occur in the off or counterclockwise direction of rotation, since it frequently requires more torque to loosen a tightened fastener, for example, then it does to tighten it.

Heretofore, driving elements have been provided with roughened or high-friction regions on the driving surfaces to improve gripping engagement with the associated driven member. Thus, for example, serrations may be provided along each driving surface. While such serrations can improve overall frictional gripping, they have heretofore provided essentially the same frictional gripping force in either direction of rotation.

SUMMARY OF THE INVENTION

It is a general object of the invention to provide an improved drive configuration for a driving element, such as a wrenching member, which avoids the disadvantages of prior drive configurations, while affording additional structural and operating advantages.

An important feature of the invention is the provision of a wrenching member which affords greater frictional force in one direction of rotation than in the other.

In connection with the foregoing feature, another feature of the invention is the provision of a wrenching member of the type set forth, which has roughened regions arranged on driving surfaces so as to provide a differential gripping force.

Certain ones of these and other features of the invention are attained by providing a wrenching member comprising: a body having two spaced-apart substantially oppositely facing drive surfaces thereon, each drive surface having first and second ends and extending in substantially the same direction from the first end to the second end, one of the drive surfaces having a high-friction roughened region thereon adjacent to its first end and an unroughened region thereon adjacent to its second end, the other of the drive surfaces having a high-friction roughened region thereon adjacent to its second end and an unroughened region thereon adjacent to its first end.

Other features of the invention are attained by providing a wrenching member comprising: a body having a plurality of drive surfaces thereon interconnected in a continuous endless series, each drive surface having first and second ends and having its first end joined to the second end of an adjacent drive surface in the series, each drive surface having a high-friction roughened region thereon adjacent to its first end and an unroughened region thereon adjacent to its second end.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
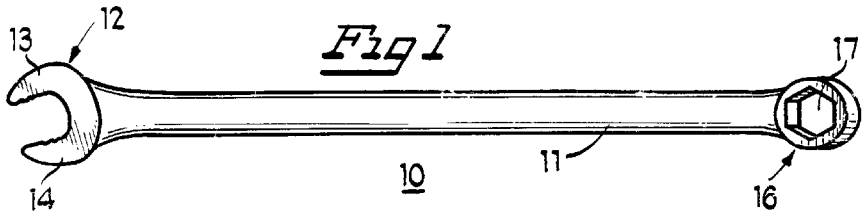
FIG. 1 is a top plan view of an end wrench having two wrenching heads, each of which is constructed in accordance with and embodies features of the present invention.

Referring to FIG. 1, there is illustrated an end wrench 10 having an elongated handle 11 provided at one end with an open-end wrench head 12 having a pair of wrenching jaws 13 and 14 separated by an arcuate throat 15, and provided at the other end with a box end wrench head 16 having an aperture 17 therethrough. In the wrench 10 of FIG. 1, the aperture 17 is hexagonal in shape, but it will be appreciated that other types of common wrenching shapes could be utilized, such as various other polygonal shapes, double hexagonal or 12-point, and the like, all in a known manner.

Figure 2:
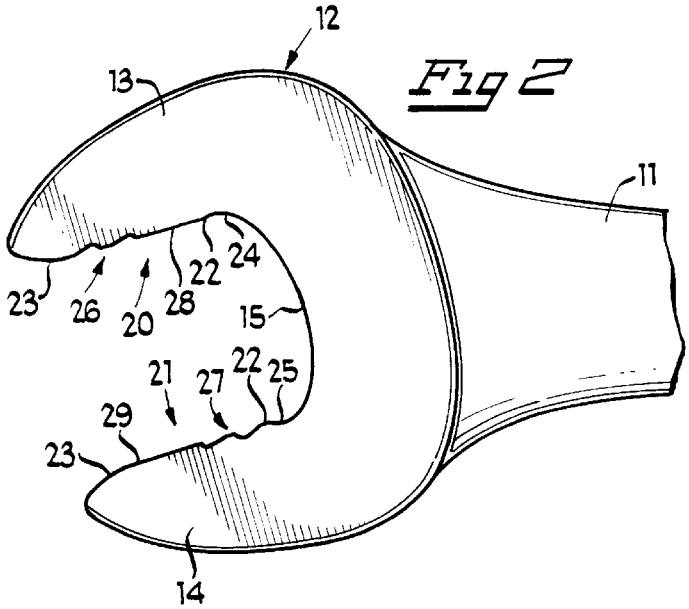
FIG. 2 is an enlarged, fragmentary, top plan view of the open-end wrenching head of the wrench of FIG. 1.

Referring also to FIG. 2, the jaws 13 and 14 of the open-end wrench head 12 are, respectively, provided with drive surfaces 20 and 21, which are disposed in spaced-apart facing relationship generally parallel to each other, in standard fashion. Each of the drive surfaces 20 and 21 extends from a first or inner end 22 to a second or outer end 23. The inner ends 22 of the drive surfaces 20 and 21 are, respectively, joined to the arcuate throat 15 by arcuate recesses 24 and 25, arranged to receive the corners of associated fasteners (not shown). The driving surface 20 has a high-friction roughened region 26 adjacent to its outer end 23 and an unroughened region 28 adjacent to its inner end 22. The drive surface 21, on the other hand, has a high-friction roughened region 27 adjacent to its inner end 22 and an unroughened region 29 adjacent to its outer end 23.

Figure 3:
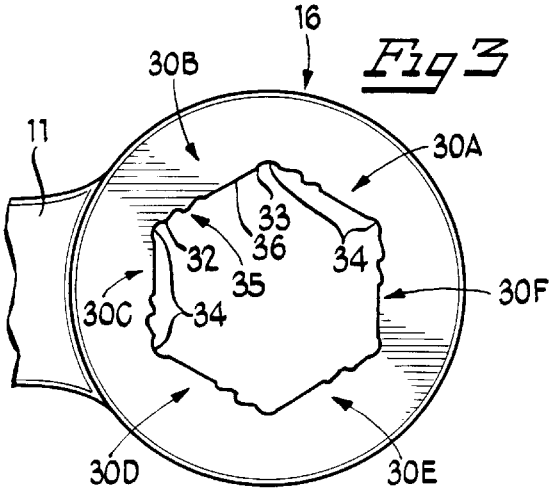
FIG. 3 is an enlarged, fragmentary, top plan view of the box end wrenching head of the wrench of FIG. 1.

Referring now also to FIG. 3, the box-end wrench head 16 has six drive surfaces 30A–30F, each of which extends from a first end 32 to a second end 33. The drive surfaces 30A–30F are joined together by arcuate recesses 34 in a hexagonal configuration, with the recesses 34 being positioned and dimensioned to respectively receive the corners of an associated and appropriately sized hexagonal fastener or other driven member, in a known manner. More specifically, each recess 34 joins the first end 32 of one drive surface to the second end 33 of an adjacent drive surface. Each of the drive surfaces 30A–30F has a high-friction roughened region 35 adjacent to its first end 32 and an unroughened region 36 adjacent to is second end 33.

Figure 5:
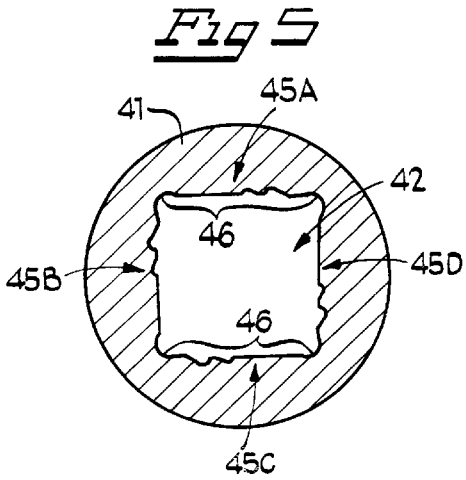
FIG. 5 is an enlarged view in horizontal section taken along the line 5—5 in FIG. 4.
Figure 4:
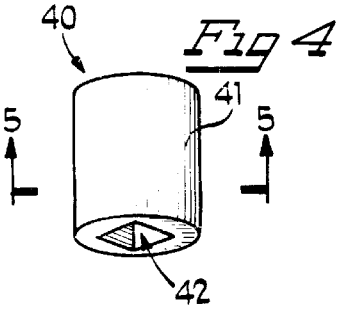
FIG. 4 is a perspective view of a socket constructed in accordance with the present invention.

Referring now to FIGS. 4 and 5, there is illustrated a socket 40 with a cylindrical body 41 having axially formed in one end thereof a drive opening 42. The drive opening 42 is substantially square in transverse cross section, defining four drive surfaces 45A–D, interconnected by corner recesses 46 dimensioned and arranged to respectively receive the corners of an associated square fastener or other driven element, in a known manner. The drive surfaces 45A–D are substantially identical, except for size, to the drive surfaces 30A–F. While a square drive opening configuration is illustrated, it will be appreciated that other common socket drive opening shapes could be utilized so as to provide any desired number of drive surfaces, it being appreciated that the angular extent of the corner recesses 46 would change with the number of drive surfaces.

It is a fundamental aspect of the invention that the drive surfaces of the several wrenching members 12, 16 and 40 are arranged so as to impart a differential frictional wrenching force to the associated fastener or other driven member. In particular, the drive surfaces are arranged so that they will impart a greater frictional driving force in the counterclockwise or "off" rotational direction (as viewed in FIGS. 2 and 3) than in the "on" or clockwise rotational direction. Thus, for example, when the wrench head 12 is torquing an associated fastener in the counterclockwise direction, the high-friction roughened regions 26 and 27 will, respectively, engage opposite sides of the fastener while the inner end 22 of the drive surface 20 and the outer end 23 of the drive surface 21 will be spaced a slight distance from the fastener sides. Conversely, when the fastener is torqued in the clockwise direction, the unroughened regions 28 and 29 will engage the fastener, while the outer end 23 off the drive surface 20 and the inner end 22 of the drive surface 21 will be spaced a slight distance from the fastener.

Preferably, each of the roughened regions 26, 27 and 35 extends from one end (22, 23 or 32) of the associated drive surface toward the other end (23, 22 or 33) thereof a distance no greater than half the length of the drive surface. While the illustrated embodiments all have an even number of drive surfaces arranged in opposed pairs, it will be appreciated that the principles of the present invention could also be applied to drive configurations having odd numbers of drive surface. Furthermore, while the disclosed embodiments are all internal drive configurations, wherein the drive surfaces face inwardly toward each other, the principles of the present invention could also be applied to external drive configurations of the type, for example, which might be used to drive socket-head fasteners or the like.

Figure 6:
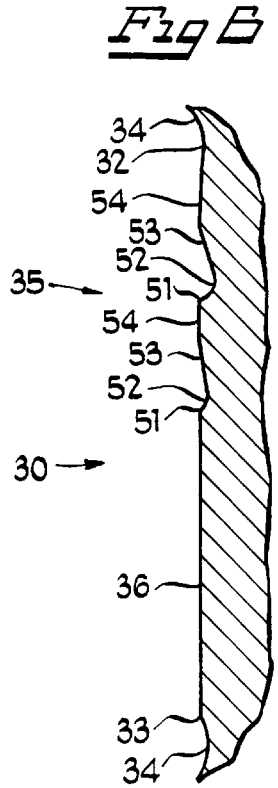
FIG. 6 is an enlarged, fragmentary, sectional view of a generic wrenching member illustrating a driving surface configuration common to all of the wrenching members of FIGS. 1–5.

Referring now to FIG. 6, there is illustrated a drive surface, generally designated by the numeral 30 which is viewed on edge from the vantage point of the user. While the reference number 30 is used for purposes of illustration, indicating that this drive surface is one of the substantially identical drive surfaces 30A–30F of FIG. 3, it will be appreciated that the drive surface 30 is also typical of the drive surfaces 20, 21 and 45A–D. FIG. 6 illustrates the details of the roughened region 35, which includes a plurality of serrations 50, it being appreciated that the identical arrangement of serrations 50 is also found in each of the roughened regions 26 and 27. Each of the serrations 50 includes a sharp tooth edge 51 joined to an arcuate recess 52, which is continuous with an inclined or sloping surface 53 which, in turn, joins a flat surface 54 which extends to the tooth edge 51 of the next serration. Preferably, the flat surfaces 54 are all substantially coplanar with the unroughened region 36 (or 27 or 28) of the drive surface.

While, in the illustrated embodiments, the roughened regions 26, 27 and 35 of the drive surfaces comprise serrations which may be formed, for example, by broaching, the roughened regions could be provided by other techniques. Thus, for example, the roughened regions could be provided by deposition onto the jaw driving surfaces of a suitable abrasive material, such as by sputter deposition, ion implantation, brazing, adhesive bonding, etc. Alternatively, the roughened regions could be formed by other processes for deforming the driving surface, such as by shot peening. Jaw driving surfaces with roughened regions formed by all of these alternative techniques are disclosed in U.S. Pat. No. 5,148,726, the disclosure of which is incorporated herein by reference.

From the foregoing, it can be seen that there has been provided an improved wrenching member having a drive configuration incorporating drive surfaces with roughened regions arranged so as to provide a differential frictional gripping force, affording greater frictional gripping in one rotational direction than the other.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A wrenching member comprising:

a body having two spaced-apart substantially oppositely facing drive surfaces thereon, each drive surface having first and second ends and extending in substantially the same direction from said first end to said second end, each drive surface, having a first portion extending substantially parallel to a plane from said first end thereof to a point between said first and second ends thereof and a second portion extending substantially parallel to said plane from said second end of said drive surface to said point, one of said drive surfaces having a high-friction roughened region thereon in the first portion thereof and being unroughened along the entirety of the second portion thereof, the other of said drive surfaces having a high-friction roughened region thereon in the second portion thereof and being unroughened along the entirety of the first portion thereof.

2. The wrenching member of claim 1, wherein said drive surfaces face toward each other.

3. The wrenching member of claim 1, wherein said two drive surfaces constitute a first pair of said drive surfaces, said body further including at least one additional pair of said drive surfaces.

4. The wrenching member of claim 1, wherein on each of said drive surfaces said roughened region has a length no greater than one-half the distance between said first and second ends.

5. The wrenching member of claim 1, wherein each of said roughened regions includes a deformed region of the associated driving surface.

6. The wrenching member of claim 5, wherein each said deformed region includes a plurality of serrations.

7. The wrenching member of claim 1, wherein said member is an open-end wrench head.

8. The wrenching member of claim 1, wherein said member is a box-end wrench head.

9. The wrenching member of claim 1, wherein said member is a socket.

10. A wrenching member comprising: a body having a plurality of drive surfaces thereon interconnected in a continuous endless series, each drive surface having first and second ends and having its first end joined to the second end of an adjacent drive surface in the series, each drive surface having a first portion extending substantially parallel to a plane from said first end thereof to a point between said first and second ends thereof and a second portion extending substantially parallel to said plane from said second end of said drive surface to said point, each drive surface having a high-friction roughened region thereon in the first portion thereof and being unroughened along the entirety of the second portion thereof.

11. The wrenching member of claim 10, wherein said plurality of drive surfaces includes an even number of drive surfaces.

12. The wrenching member of claim 11, wherein said drive surfaces are six in number and are arranged in a hexagonal configuration.

13. The wrenching member of claim 11, wherein said drive surfaces are four in number and are arranged in a square configuration.

14. The wrenching member of claim 10, wherein said drive surfaces face inwardly toward one another.

15. The wrenching member of claim 10, wherein on each of said drive surfaces said roughened region has a length no greater than one-half the distance between said first and second ends.

16. The wrenching member of claim 10, wherein each of said roughened regions includes a deformed region of the associated driving surface.

17. The wrenching member of claim 16, wherein each said deformed region includes a plurality of serrations.

18. The wrenching member of claim 10, wherein said member is a box-end wrench head.

19. The wrenching member of claim 10, wherein said member is a socket.

* * * * *